US005702501A

United States Patent [19]

Osawa et al.

[11] Patent Number: 5,702,501

[45] Date of Patent: Dec. 30, 1997

[54] CLAYISH COMPOSITION FOR MOLDING SHAPED ARTICLE OF NOBLE METAL AND METHOD FOR PRODUCTION OF SINTERED ARTICLE OF NOBLE METAL

[75] Inventors: Yukio Osawa, Machida; Katsuhiko Shimamoto, Hino; Shinichi Ishigaki, Kanagawa-ken; Hitoshi Araki, Tachikawa; Yukio Nakata, Hachioji; Atsushi Fujimaru, Fuchuu, all of Japan

[73] Assignee: Aida Chemical Industries Co., Ltd., Tokyo, Japan

[21] Appl. No.: 711,788

[22] Filed: Sep. 10, 1996

[30] Foreign Application Priority Data

Feb. 23, 1996 [JP] Japan ..... 8-060241

[51] Int. Cl.$^6$ ..... B22F 1/00

[52] U.S. Cl. ..... 75/255; 75/252

[58] Field of Search ..... 419/36, 37; 75/255, 75/252

[56] References Cited

U.S. PATENT DOCUMENTS 5,010,220 4/1991 Apte et al. .
5,328,775 7/1994 Hoshino et al. .
5,376,328 12/1994 Hoshino et al. .
5,387,564 2/1995 Takeuchi et al. .

FOREIGN PATENT DOCUMENTS 4-26707 1/1992 Japan .
4-66605 3/1992 Japan .
5-140611 6/1993 Japan .
6-99723 12/1994 Japan .

*Primary Examiner*—Charles T. Jordan
*Assistant Examiner*—Anthony R. Chi
*Attorney, Agent, or Firm*—Oblon, Spivak, McClelland, Maier & Neustadt, P.C.

[57] ABSTRACT

A clayish composition for producing a molded article of noble metal consists essentially of a noble metal powder, starch and a water-soluble cellulose resin as organic binder and water. The contents of the starch and the water-soluble cellulose resin each fall in the range of 0.02–3.0% by weight, based on the total amount of the organic binder and the noble metal powder. A method for producing the sintered article of noble metal consists essentially of a step for producing the clayish composition mentioned above, a step of molding the clayish composition in a desired shape, a step of drying the molded article and a step of sintering the dried molded article.

14 Claims, 1 Drawing Sheet

CLAYISH COMPOSITION FOR MOLDING SHAPED ARTICLE OF NOBLE METAL AND METHOD FOR PRODUCTION OF SINTERED ARTICLE OF NOBLE METAL

BACKGROUND OF THE INVENTION

1. Field of the Invention

This invention relates to a clayish composition for molding a shaped article of noble metal to be used as the raw material for the manufacture of such molded noble metal articles as, for example, precious decorative articles, articles of fine art and decorative articles exhibiting a high degree of craftmanship and to a method for the production of a sintered article of noble metal. More particularly, the invention relates to a clayish composition for molding a shaped article of noble metal such that the shaped article exhibits high dry strength prior to sintering, incurs only slight shrinkage during sintering, and produces a sintered article of high strength, and a method for the production of a sintered article of noble metal.

2. Description of the Prior Art

Heretofore in the production of a sintered article of noble metal exhibiting a high degree of craftmanship, it has been customary to manufacture the sintered article of noble metal by preparing a clayish composition formed basically of a noble metal powder and a binder, molding this composition in a prescribed shape, drying the shaped article of the composition, then treating the dried shaped article in an electric furnace or a kiln thereby expelling the binder from the shaped article by decomposition, evaporation, combustion, etc., and sintering the component particles of the noble metal powder (Japanese Patent Public Disclosure Hei 4(1992)-26707 and Japanese Patent Public Disclosure Hei 4(1992)-66605).

As such a clayish composition for molding a shaped article of noble metal as described above, there is commercially available a product obtained by using a noble metal powder, a binder and a solvent as basic raw materials, further appropriately mixing these raw materials with such additives as a surfactant serving to promote blending, oil or fat serving to prevent the raw materials from adhering to the hands and a plasticizer, and kneading the resultant mixture into a clayish mass. As the noble metal powder in this clayish composition, the powders of such noble metals as gold, platinum, palladium and silver and the powders of alloys of these noble metals are usable. These powders are mainly used in the form of granular particles, particles of irregular shape, or flat particles, having an average particle diameter of not more than 200 μm. As the binder, water-soluble cellulose resins, acrylic resins, polyvinyl alcohols, synthetic rubbers, waxes and polyethylene resin are usable. The percentage of binder incorporated in the composition is appropriately in the approximate range of 15–30% by weight, based on the amount of the composition. As the plasticizer, phthalic esters, higher fatty acids, higher fatty esters and liquid paraffins are usable. The surfactant is used for the purpose of improving the mixability of the noble metal powder with the binder and the oil or fat is added in a small amount to prevent the clayish composition from adhering to the hands.

Then, the clayish composition formed in this manner is molded into a desired shape, dried and subsequently fired in an electric furnace or a kiln over a long period in the range of 3–10 hours to obtain a sintered article of noble metal.

When the clayish composition formed as described above is used, however, the prefired shaped article obtained by the molding and drying steps has low strength. The composition is therefore disadvantageous in that the prefired article shape therefrom easily sustains fracture owing to slight external forces exerted thereon in the course of normal handling. Further, since the clayish composition contains the plasticizer, surfactant and oil or fat, the shaped article thereof, when sintered quickly, may produce a sintered article deformed by rapid decomposition, vaporization and combustion of the organic substances present therein. The sintering therefore requires complicated temperature control. Moreover, the sintering must be continued for a long time (in the range of 3–10 hours) and, as an inevitable consequence, the energy cost is high. Since the combined content of such organic substances as the plasticizer, surfactant and oil or fat in the clayish composition is large, i.e. exceeds about 20% by weight, the clayish composition has the disadvantage that the shaped article thereof shrinks markedly during sintering and the finished article inevitably assumes a different form from that imparted during molding. (The shrinkage during sintering is aggravated when the noble metal powder is formed of porous or microfine particles.)

Further, because of the low strength mentioned above, molded articles of a particularly small wall thickness or a complicated shape formed three-dimensionally of linear components, about 0.5 mm in thickness, are liable to deform under their own weight or sinter unevenly. In an attempt to prevent such a shaped article from deforming under its own weight or sintering unevenly Japanese Patent Public Disclosure Hei 5(1993)-140611, for example, discloses a method which comprises burying a clayish molded article in a mass of a ceramic powder and heating and sintering the clayish molded article as supported in the ceramic powder within a heating furnace or a kiln. Owing to the use of the ceramic powder as a support, however, this method requires a great amount of energy for the sintering because the heat conduction to the core of the shaped article is inefficient, extra heat is required for the ceramic powder, and an hour or more is generally required for elevating the temperature of the entire system to the sintering temperature. Depending on the shape of the clayish molded article, this method is unable to solve the problem of uneven sintering because uniform temperature cannot be achieved throughout all parts of the molded article.

Depending on the kind of noble metal powder used, the heating must be conducted in a reducing ambience, in which case a high-performance heating furnace must be used. In an effort to solve this problem, Japanese Patent Publication Hei 6(1994)-99723, for example, discloses a method which enables even an ordinary heating furnace to accomplish the required sintering in a reducing ambience by placing a clayish composition together with a carbonaceous material such as charcoal and ceramic particles serving as a supporting material in a tightly closed container and sintering this clayish composition so held in the container, thereby producing a reducing ambience inside the tightly sealed container owing to thermal decomposition or combustion of the carbonaceous material. Since this method likewise uses the ceramic powder, the sintering consumes much time and entails high energy cost. Depending on the shape of the closed container and the shape of the clayish molded article, the sintering tends to proceed unevenly.

A need exists for a clayish composition enabling a shaped article formed therefrom and dried to exhibit high strength, incur only slight shrinkage during sintering, and produce a sintered article of high strength. Further, a need is felt for a sintering method which reduces sintering time and sintering energy cost and which preferably enables sintering to be accomplished easily with high evenness in a reducing ambience without requiring the use of a special electric furnace, kiln or other such equipment.

SUMMARY OF THE INVENTION

The present invention was accomplished in light of the foregoing problems of the prior art.

This invention is directed to a clayish composition for producing a molded article of noble metal, consisting essentially of at least one noble metal powder selected from the group consisting of noble metal powders and noble metal alloy powders, starch and a water-soluble cellulose resin as organic binder, and water, wherein the contents of the starch and the water-soluble cellulose resin each falls in the range of 0.02–3.0% by weight, based on the total amount of the organic binder and the noble metal powder, and to a method for the production of a sintered article of noble metal, consisting essentially of a step of mixing and kneading at least one noble metal powder selected from the group consisting of noble metal powders and noble metal alloy powders with an aqueous solution of an organic binder consisting of starch and a water-soluble cellulose resin to produce a clayish composition wherein the contents of the starch and the water-soluble cellulose resin are each in the range of 0.02–3.0% by weight based on the total amount of the organic binder and the noble metal powder, a step of molding the clayish composition into a desired shape, a step of drying the resultant shaped article and a step of sintering the dried shaped article.

DESCRIPTION OF THE PREFERRED EMBODIMENTS

Figure 1:
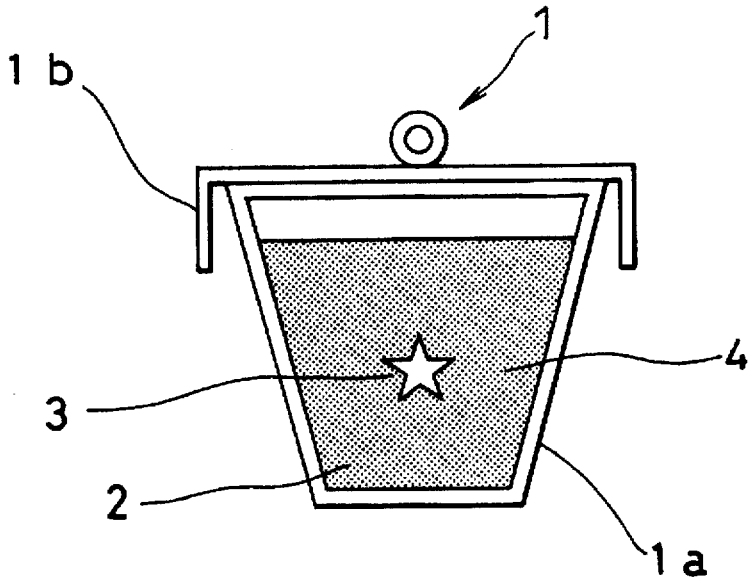
FIG. 1 is a cross section schematically showing a heat-resistant container holding therein a shaped article of a clayish composition, a microwave-absorbing heat-generating granular powder, etc.

The noble metal powder used in this invention is a powder of at least one member selected from the group consisting of pure noble metals such as Au, Ag, Pt, Pd, Rh, Ru, Ir and Os and noble metal alloys having at least one of these pure noble metals as a main component. Preferably, at least 90% of the powder particles have diameters in the range of 1–100 micrometers. Preferably, the particle diameters are distributed to have an average size in the range of 5–30 micrometers. When the noble metal powder described above is combined with an organic binder and water to form a clayish composition for forming a molded article of noble metal and this clayish composition is shaped and sintered, the finished sintered article of noble metal exhibits high density and consequent low shrinkage because small particles are interposed among scattered large particles so as to fill up the gaps between the large particles.

The shape of the individual particles of the noble metal powder is not particularly limited and may, for example, be spherical, lump or teardrop. Advantageously, the powder has a high density and contains voids at a low ratio. A powder produced by the wet method, for example, contains many voids. When the shaped article of this powder is sintered, the particles of the powder undergo thermal fusion and tend to assume a spherical shape owing to surface tension, and the powder tends to gain in density as the voids are filled with the molten metal. As a result, the apparent volume of the finished molded article decreases and the shrinkage thereof increases.

The starch used in this invention is known in two kinds, i.e. β-starch which is insoluble in cold water, lacks viscosity and resists enzymatic digestion or decomposition and α-starch which is soluble even in cold water. Generally, when the β-starch insoluble in cold water is combined with water and then heated, the particles of the starch begin to swell and then acquire viscosity and eventually assume the state of a homogeneous transparent or translucent paste. This state results from α-conversion and forms α-starch. By quickly dehydrating the α-starch, drying the product of dehydration and pulverizing the dried product there is obtained α-conversion starch. α-conversion starch quickly dissolves even in cold water and gives rise to a pasty liquid. Either of the two forms of starch can be used in this invention.

The strength of the clayish molded article after drying is enhanced when the clayish composition contains starch. When starch alone is used as an organic binder, however, the clayish molded article tends to crack and the clayish composition tends to adhere to the hands. These problems can be eliminated by using starch in combination with a water-soluble cellulose resin. In this case, even when an extremely slender article is three-dimensionally molded, it does not deform or fracture during drying, and adherence of the clayish composition to the hands is slight. As mentioned earlier, the starch is added to the noble metal powder at a ratio in the range of 0.02–3.0% by weight, based on the total amount of the noble metal powder and the binder. If this ratio is less than 0.02% by weight, the molded article will have insufficient strength and tend to fracture during drying. The molded article is liable to fracture, for example, when it is released from a mold. If the ratio exceeds 3.0% by weight, the clay exhibits elasticity in the course of molding, becomes difficulty to form into a desired shape and size, and cracks. The shrinkage also increases.

The water-soluble cellulose resin is also added to the noble metal powder at a ratio in the range of 0.02–3.0% by weight, based on the total amount of the noble metal powder and the binder. If this ratio is smaller than 0.02%, the effect of preventing the clay from cracking will not be fully manifested and the molded article will tend to crack during drying and the clayish composition will tend to adhere to the hands. If the ratio exceeds 3.0% by weight, the clayish composition will again tend to adhere to the hands and the shrinkage will also increase. Typical examples of the water-soluble cellulose resin include methyl cellulose, hydroxyethyl cellulose, hydroxypropyl cellulose and hydroxypropylmethyl cellulose. The water-soluble cellulose resin is used as dissolved in water.

The amount of the organic binder composed of the starch and the water-soluble cellulose resin is in the range of 0.1–4% by weight, based on the total amount of the organic binder and the noble metal powder. If the amount of the organic binder is less than 0.1% by weight, the clayish composition will have inferior moldability and poor shape-retaining property. It will also manifest low strength after being molded and dried. If the amount of the organic binder exceeds 4% by weight, the clayish composition will exhibit high adhesiveness to the hands and will increase in tackiness. The clayish composition will also become difficult to mold to a desired shape and size because it becomes elastic rather than perfectly plastic. The amount of the organic binder is therefore preferably in the range of 0.1–4% by weight.

If the amount of water in the clayish composition is unduly small, the clay will be too hard to manifest proper moldability. If the amount is unduly large, the clay will be too soft to permit convenient handling and will increase in adhesiveness to the hands. Further, water evaporization during drying will cause a decrease in volume and lead to an increase in the amount of shrinkage after sintering.

A typical procedure for manufacturing the clayish composition of this invention for molding a shaped article of noble metal from the component materials mentioned above will now be described. First, the aqueous solution of an organic binder is prepared by thoroughly mixing a water-soluble cellulose resin and starch, which have different dissolving conditions, both in a powdered state, placing the resultant mixture in hot water, dispersing and heating the powder in the hot water thereby first dissolving the β-starch, and then allowing the hot water containing the powder to cool spontaneously thereby dissolving the water-soluble cellulose resin. Conversely, the mixture may be dispersed in cold water to first dissolve the water-soluble cellulose resin and the cold water containing the powder be subsequently heated to dissolve the β-starch. The aqueous solution of the organic binder is then mixed with a noble metal powder at a prescribed ratio and thoroughly kneaded to obtain a clayish composition.

Sintered articles were produced by combining a noble metal powder with an organic binder to prepare a clayish composition, molding the clayish composition into a desired shape, and sintering the molded article. Table 1 shows how the properties of the sintered articles varied with the organic binder content of the clayish composition, in % by weight based on the total amount of the noble metal powder and the organic binder.

TABLE 1

| Content of organic binder (wt %) | 0.05 | 0.1 | 1.0 | 4.0 | 5.0 |
|---|---|---|---|---|---|
| Adhesiveness to hands (tackiness) | x | o | ⊙ | o | x |
| Moldability/plasticity | x | o | ⊙ | o | x |
| Dry strength of molded clayish composition | x | o | ⊙ | ⊙ | ⊙ |
| Shrinkage after sintering | ⊙ | ⊙ | ⊙ | o | x |

*Pure silver powder was used as the noble metal powder and water was added so as to impart the optimum hardness to the produced clayish composition. The sintering was performed by drying the molded article and then elevating the temperature of the molded article from room temperature to 800° C. over a period of 60 minutes, during which the article was sintered at temperatures between 710–800° C. for a period of 10 minutes.
The properties indicated in the table were rated on the following scales.
Adhesiveness to hands:
⊙-Absolutely no adhesion
o-Slight adhesion, no tackiness to hands
x-Tackiness to hands
Moldability/plasticity:
⊙-Absolutely no deformation
o-Plastic deformation
x-Elastic deformation
Dry strength:
⊙-Difficult to break and substantially registant to minor scars
o-Difficult to break
x-Liable to break during handling
Shrinkage after sintering:
⊙-Not more than 2%
o-Not more than 10%
x-10% or more The "molding [of] the clayish composition into a desired shape" is generally conducted by forming the composition in an arbitrary shape either manually or by use of a suitable tool. However, it can also be conducted by depositing the clayish composition fast on the surface of a separately fabricated appropriate supporting article by wrapping the supporting article with the composition or pressing the composition against the supporting article. In this invention, therefore, composites having the clayish composition deposited on the surface of a suitable supporting material are also referred to as molded articles.

The substance of the supporting material is not particularly limited. It may be cast metal or a ceramic material such as stone, for example. Alternatively, a three-dimensional molded article prepared in advance such as with the clayish composition may be used as the supporting material. In the case of a molded article which uses this supporting material, during the sintering, which will be specifically described hereinbelow, the sintering of the supporting material and that of the clayish composition deposited on the surface thereof proceed simultaneously. In the case of this molded article it is possible to produce sintered articles of different colors by making the kind and amount of the noble metal powder in the clayish composition of the supporting material different from the kind and amount of the noble metal powder in the clayish composition deposited on the surface of the supporting material. The supporting material may also be a three-dimensional molded article formed of a clayish substance obtained by kneading a microwave-absorbing heat-generating powder with an organic binder. Since this supporting material functions as a core, it is highly suitable for the production of a hollow sintered article. It also serves as a heat-generating medium when sintering is conducted in a microwave oven, as will be described later.

After the invention clayish composition for producing a molded article of noble metal has been formed into the desired shape and the formed article been dried the dried article can be sintered in either of two ways: by use of a heating furnace or by use of a microwave oven.

First, in the method using the heating furnace, the temperature is preferably set 70°–250° C. lower than the melting point of the noble metal powder. If the sintering is carried out at a temperature higher than 70° C. below the melting point, the formed article of the noble metal powder will be deformed by thermal fusion. If the sintering is effected at a temperature lower than 250° C. below the melting point, the formed article of the noble metal power will not be sintered sufficiently and the sintered article will be low in strength and susceptible to cracking.

The sintering time is preferably at least 5 minutes where the sintering temperature is in the range of 70°–250° C. lower than the melting point of the noble metal powder. If the sintering time is less than 5 minutes, the degree of sintering will differ markedly with slight difference in the sintering time or the size of the molded article and the sintering may proceed insufficiently.

Table 2 shows the melting points of pure noble metal powders and the temperatures used for sintering the clayish compositions produced with the noble metal powders.

TABLE 2

| Pure noble metal powder | Melting point | Range of optimum sintering temperatures |
|---|---|---|
| Gold | 1063° C. | 810–990° C. |
| Silver | 960° C. | 710–890° C. |
| Platinum | 1769° C. | 1520–1700° C. |
| Palladium | 1552° C. | 1300–1480° C. |

The method using microwave heating, specifically the method using a microwave oven, will now be described.

This method comprises forming the clayish composition into a desired shape, drying the formed article, burying the dried formed article in a mass of microwave-absorbing heat-generating particles which measure 5–3500 μm in diameter, manifest flowability as a mass and generate heat by absorbing microwaves, placing the shaped article as held in the mass of heat-generating particles in a microwave oven, and heating it therein for a period in the range of 2–20 minutes.

The microwave-absorbing heat-generating particles used in this method are formed of at least one member selected from the group consisting of particulate, carbon, active carbon, ferrite, silicon carbide, boron carbide, boron nitride, aluminum nitride, iron oxide, cast iron, iron, copper, zinc oxide, barium titanate, barium zirconate and lead titanate. They are in the form of granules, particulates, whiskers, or fibers which manifest flowability as a mass. These microwave-absorbing heat-generating particles may incorporate particles of an electroconductive substance such as a metal or the particles of a dielectric substance such as a ceramic at a suitable ratio. The heat-generating particles manifest a higher microwave-absorbing heat-generating property than the molded article to be sintered and are not sintered even at the highest temperature reached in the course of sintering. Appropriately, the particles have diameters in the range of 5–3500 μm, preferably 10–1000 μm. If the particle diameters are smaller than 5 μm, the particles will adhere so fast to the surface of the sintered article as to be difficult to separate therefrom. If the diameters exceed 3500 μm, the particles will be deficient in flowability and density. The number of voids occurring among the particles decreases and, consequently, the ease with which the reducing ambience forms increases with decreasing particle diameter. The problem of the void occurrence cannot be completely eliminated by reducing particle diameter, however, owing to the aforesaid need to set a lower limit on particle size. It can, however, be overcome by using particles of relatively small diameters in combination with particles of relatively large diameters.

Where the sintering requires a reducing ambience, a reducing agent is incorporated in the microwave-absorbing heat-generating particles. Usable reducing agents include the particles of such carbon-rich substances as carbon, charcoal, active carbon, pulp, chips (wood), straw, hulls or coke and such easily oxidizable metals as iron, copper and aluminum. The carbon, active carbon, iron, copper etc. therefore serve as microwave-absorbing heat-generating particles with reducing property.

The container for holding the microwave-absorbing heat-generating particles is formed of a material which passes microwaves with low loss and resists fusion, deformation and fracture even at the highest temperature reached during sintering. Specifically, the container is preferably made of a material that permits repeated use. Usable materials meeting these requirements include alumina, cordierite, enstatite, mullite, silica, lithia, zirconia, calcia, magnesia and diatomaceous earth.

The period of exposure of the formed article to the microwaves, i.e. the actual period of heating the formed article in the microwave oven can be adjusted by varying such factors as the shape of the molded article, the kind and amount of the microwave-absorbing heat-generating particles, and the type of microwave oven. However, it is preferably set in the range of 1–20 minutes, more preferably 5–10 minutes. If the time is less than 1 minute, problems such as insufficient sintering, uneven sintering and partial fusion are apt to arise. If the time exceeds 20 minutes, reflected microwaves increase the load on the magnetron (microwave generator) in the microwave oven and also raise the energy cost.

When carbon, for example, is incorporated in microwave-absorbing heat-generating particles formed of ferrite or silicon carbide, it heightens the efficiency of heat generation. When silicon carbide and active carbon are used as the microwave-absorbing heat-generating particles, the temperature-increasing rate can be lowered by enlarging the diameters of these particles or increasing the amount of such particles to be held in the container. Conversely, the temperature-increasing rate can be heightened by adjusting the mixing ratio of silicon carbide/active carbon so as to increase the proportion of silicon carbide. The sintering temperature and the temperature-increasing rate, namely the heating time, can be adjusted by properly selecting the combination, mixing ratio and amounts of a plurality of species of microwave-absorbing heat-generating particles.

An example of the sintering step according to this invention will be described below with reference to the schematic diagrams in the attached drawings.

Referring to FIG. 1, 1*a* designates a heat-resistant container, such as a ceramic crucible, and 1*b* designates a lid for the container. A heat-resistant container 1 is obtained by combining these components 1*a* and 1*b*. The lid 1*b* is necessary for retaining a reducing ambience inside the heat-resistant container 1 during the sintering. It need not be used if the sintering conditions permit. This heat-resistant container 1 is charged with microwave-absorbing heat-generating particles 2 incorporating a reducing agent 4. A molded article 3 prepared in advance by forming a clayish composition into the shape of a star, for example, and drying the formed article is buried in the mass of the microwave-absorbing heat-generating particles 2.

Figure 2:
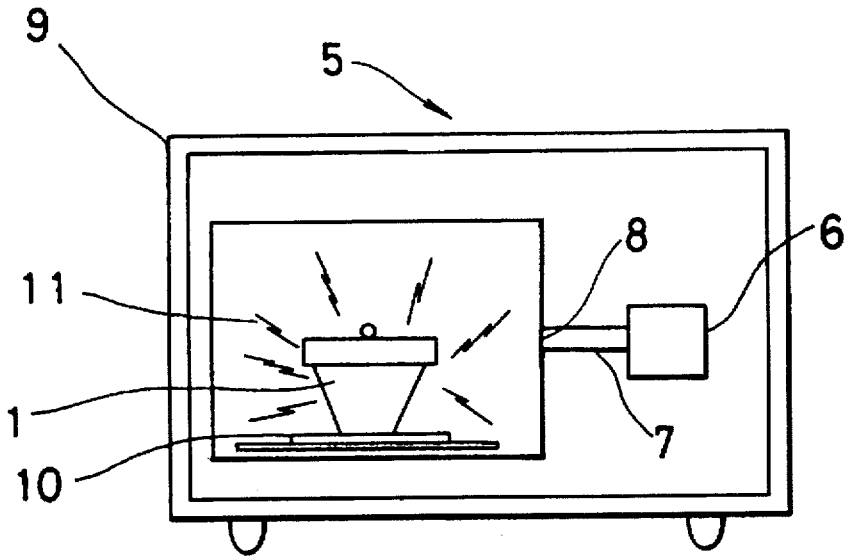
FIG. 2 is a cross section schematically showing a step of sintering by means of a microwave oven.

This heat-resistant container 1 is set inside a microwave oven 5 as shown in FIG. 2 and is kept heated for a prescribed length of time. In the diagram, 6 designates a microwave-generating device (magnetron), 7 a waveguide, 8 a coupling window, 9 a housing and 10 a heat-resistant insulator formed of a material which substantially does not absorb microwaves and does not yield to fusion, deformation, or fracture even at the highest temperature reached during sintering. The insulator 10 suppresses the release of heat from the heat-resistant container 1 and protects the microwave oven 5 against the possible damage by heat from the container 1.

When the microwave oven 5 is turned on, the microwave-generator 6 emits microwaves 11. The microwaves 11 pass through the heat-resistant container 1 and are absorbed by the microwave-absorbing heat-generating particles 2 held in the heat-resistant container 1. The microwave-absorbing heat-generating particles 2 which have absorbed the microwaves 11 quickly generate heat which heats and sinters the molded article 3. At this time, the reducing agent 4 is burned or oxidized by the heat emitted from the microwave-absorbing heat-generating particles 2, thereby creating a reducing ambience inside the heat-resistant container 1. Since the clayish molded article 3 is buried in the mass of microwave-absorbing heat-generating particles 2, its exposure to oxygen entering the heat-resistant container for cooling after the step of sintering in a reducing ambience is impeded by the microwave-absorbing heat-generating particles 2. Moreover, thermal deformation of the molded article 3 is prevented since its entire periphery is supported by the microwave-absorbing heat-generating particles 2. Even when the molded article 3 is produced by three-dimensionally forming an extremely thin linear material, about 0.5 mm in thickness, for example, it is prevented from thermal deformation and enabled to retain its original shape.

Although the clayish composition of this invention for producing the sintered article of noble metal uses absolutely no surfactant, plasticizer, oil or fat, it rarely adheres to the hands in the course of manual molding. If a small amount should adhere to the hands, it returns to the mass of the composition after the hands are rubbed together. After this, it almost never sticks to the hands again. The clayish composition is therefore very easy to handle. Owing to the absence of such additives as surfactant, plasticizer, and oil or fat, the molded article after drying has many voids and, when quickly heated during the step of sintering, rarely swells and deforms because the otherwise possible occlusion by the additives mentioned above of the openings for the escape of the gas and vapor arising from the decomposition of the organic binder is precluded. Further, since the molded article has high dry strength, it very rarely sustains fracture while being handled prior to the sintering. Besides, the sintering can be accomplished quickly and easily because the process of sintering does not require strict control of the temperature elevation profile and requires only that the temperature and time be controlled in the proximity of the highest temperature.

Further, the shrinkage of sintered article does not exceed about 10% and its strength is high enough to prevent fracture upon accidental dropping.

The present invention very effectively eliminates the disadvantages of the prior art and enables rapid production of a sintered article of noble metal with high strength and low shrinkage.

The clayish composition of this invention rarely deforms by swelling even when it is quickly heated over a period in the approximate range of several minutes to some tens of minutes. It therefore can be thoroughly sintered.

This invention also markedly reduces sintering time because the sintering can be accomplished by heating the molded article from room temperature to the prescribed sintering temperature in a heating furnace, by placing the molded article after drying in a heating furnace heated in advance to the prescribed sintering temperature and allowing it to stand therein for a prescribed time, or by burying the molded article after drying in microwave-absorbing heat-generating particles and sintering it so buried in a microwave oven.

When a household grade microwave oven is used instead of an electric furnace or kiln or a special appliance or device, the sintered article can be produced quickly, inexpensively and conveniently. Further, the deformation of the molded article under its own weight which tends to occur during sintering can be prevented and, when necessary, the sintering can be easily implemented in a reducing ambience. Even a sintered article of a shape obtained by three-dimensionally molding a linear material about 0.5 mm in thickness, for example, can be easily obtained with the shape imparted during the step of molding kept intact.

The present invention will now be described specifically below with reference to working examples.

EXAMPLE 1

Clayish compositions having components mixed in the different ratios shown Table 3 were prepared by using silver powders having particle diameters in the range of 1–90 micrometers and an average particle diameter of 16 micrometers, methyl cellulose (marketed as Metrose SM8000 by Shin-etsu Chemical Industry Co., Ltd.), and β-potato starch (marketed as Delica M-9 by Nichiden Kagaku K. K.) as raw materials. Though water was added to the compositions in amounts selected to impart the optimum clay consistency, the amounts of water so added are not included in the relevant calculations.

The clayish compositions thus prepared were tested for the following five items. The results are also shown in Table 3.

(1) Cohesion/fracture of molded article: A sample of the clayish composition was tested for cohesiveness of clay and for the occurrence of cracks in the mass of clay during the elongation thereof. The results were rated on a three-point scale, wherein x stands for occurrence of cracks in the mass of clay, o for occurrence of few cracks in the mass of clay, and ⊙ for total absence of occurrence of cracks in the mass of clay.

(2) Sticking to hands: A sample of the clayish composition was tested for sticking to the hands during manual molding thereof. The results were rated on a three-point scale, wherein x stands for sticking to hands, o for tackiness to hands without sticking, and ⊙ for total absence of sticking.

(3) Moldability: A sample of the clayish composition was manually molded to determine the ease of molding and plastic deformability of the clay. A composition that elastically deforms tends to resume its original shape and is not suitable as a clay. The results were rated on a three-point scale, wherein x stands for occurrence of elastic deformation, o for occurrence of plastic deformation, and ⊙ for good ease of molding of the clayish composition and no deformation of the molded article.

(4) Strength of molded article after drying: For the purpose of shaping the clayish composition in a mold and testing the molded article in a dried state for strength during release from the mold, a silver clay was molded to obtain test pieces measuring 100 mm in length, 10 mm in width and 1.0 mm in thickness, and the test pieces were dried at 100° C. for 30 minutes and then tested for dry strength. The results were rated on a three-point scale, wherein x stands for susceptibility to fracture during handling, o for resistance to fracture, and ⊙ for resistance to fracture and minor scars.

(5) Shrinkage: Test pieces prepared and dried in the same manner as those for testing the dry strength mentioned above were placed in an electric furnace and heated therein from room temperature to 800° C. over a period of one hour. The electric furnace was turned off at 800° C. and the hot test pieces were left to cool in the furnace to 600° C. and then removed from the furnace (the temperature of the test pieces was above 710° C. for about 20 minutes) and tested for shrinkage between the clayish state and the sintered state. The results were rated on a three-point scale, wherein x stands for a shrinkage exceeding 10%, o for a shrinkage not exceeding 10%, and ⊙ for a shrinkage not exceeding 2%.

The results are shown in Table 3.

TABLE 3

| Starch content (%) | | Cellulose content (%) 0.01 | 0.02 | 0.1 | 1.0 | 3.0 | 4.0 |
|---|---|---|---|---|---|---|---|
| 0.01 | Cohesiveness/fracture of mass of clay | x | x | o | o | o | o |
| | Sticking to hands | o | o | o | o | o | x |
| | Moldability | x | o | o | ◎ | o | o |
| | Dry strength | x | x | x | x | x | x |
| | Shrinkdage | ◎ | ◎ | ◎ | ◎ | o | x |
| 0.02 | Cohesiveness/fracture of mass of clay | x | x | o | o | o | o |
| | Sticking to hands | o | o | o | ◎ | o | o |
| | Moldability | x | o | o | ◎ | o | o |
| | Dry strength | x | x | o | o | o | o |
| | Shrinkage | ◎ | ◎ | ◎ | ◎ | o | x |
| 0.1 | Cohesiveness/fracture of mass of clay | x | o | o | ◎ | ◎ | ◎ |
| | Sticking to hands | o | o | ◎ | ◎ | o | x |
| | Moldability | x | o | o | ◎ | o | o |
| | Dry strength | x | o | ◎ | ◎ | ◎ | ◎ |
| | Shrinkage | ◎ | ◎ | ◎ | ◎ | o | x |
| 1.0 | Cohesiveness/fracture of mass of clay | x | o | o | ◎ | ◎ | ◎ |
| | Sticking to hands | ◎ | ◎ | ◎ | ◎ | o | x |
| | Moldability | x | o | o | ◎ | o | o |
| | Dry strength | o | o | ◎ | ◎ | ◎ | ◎ |
| | Shrinkage | ◎ | ◎ | ◎ | ◎ | o | x |
| 3.0 | Cohesiveness/fracture of mass of clay | x | o | o | ◎ | ◎ | ◎ |
| | Sticking to hands | o | o | ◎ | o | o | x |
| | Moldability | o | o | o | o | o | x |
| | Dry strength | ◎ | ◎ | ◎ | ◎ | ◎ | ◎ |
| | Shrinkage | o | o | o | o | x | x |
| 4.0 | Cohesiveness/fracture of mass of clay | x | o | o | ◎ | ◎ | ◎ |
| | Sticking to hands | o | o | o | o | o | x |
| | Moldability | o | o | o | o | x | x |
| | Dry strength | ◎ | ◎ | ◎ | ◎ | ◎ | ◎ |
| | Shrinkage | x | x | x | x | x | x |

In Table 3, the clays enclosed by thick lines are suitable for practical use.

EXAMPLE 2

In 833 ml of hot water (53° C.), 95 g of methyl cellulose (marketed as Metrose SM8000 by Shin-etsu Chemical Industry Co., Ltd.) and 72 g of β-potato starch (marketed as Delica M-9 by Nichiden Kagaku K. K.) were stirred to thorough dispersion. Then, the resultant dispersion was heated to 90° C. to effect a-conversion of the starch. The produced mixture was cooled to room temperature to dissolve the methyl cellulose and form an aqueous organic binder solution.

With 4.5 g of this aqueous organic binder solution, 95.5 g of a noble metal powder (having particle diameters in the range of 1–90 micrometers and an average particle diameter of 15 micrometers) shown in Table 4 was thoroughly kneaded. When the blend had progressed from the powdery state through the doughy state to the clayish state, it was placed on three superposed food wrapping films and further kneaded thoroughly to obtain a clayish composition.

Test pieces were produced from the clayish composition in the same manner as in Example 1. Each test piece was heated in an electric furnace from room temperature to the sintering temperature (highest temperature) shown in Table 4, then left to cool to about 600° C. in the furnace, removed from the furnace, left to cool to room temperature, and tested for shrinkage. The results are also shown in Table 4.

TABLE 4

| No. | Noble metal powder | Sintering temperature (highest temp.) (°C.) | Elevation of temperature from room temperature (Room temperature to highest temperature): Range of optimum sintering temperature (°C.) | Period in optimum sintering temperature range (min) | Sintering ambience | Cooling time (min) | Shrinkage (%) |
|---|---|---|---|---|---|---|---|
| 1 | Au + Pt (80:20) | 980 | 850~1030 | 30 | Oxidizing | 30 | 9.1 |
| 2 | Pd + Ag (20:80) | 900 | 800~980 | 20 | Oxidizing | 20 | 8.7 |
| 3 | Pt + Pd (80:20) | 1500 | 1400~1580 | 50 | Oxidizing | 50 | 9.3 |
| 4 | Au + Ag + Cu (75:12.5:12.5) | 870 | 800~980 | 25 | Reducing | 25 | 8:2 |
| 5 | Au + Ag + Cu+Ti (75:15:9:1) | 890 | 800~980 | 25 | Reducing | 25 | 8.3 |
| 6 | Au + Ag + Cu + Si (82:10:6.5:1.5) | 880 | 800~980 | 25 | Reducing | 25 | 7.0 |
| 7 | Au + Cu + La (90:8:2) | 880 | 800~980 | 25 | Reducing | 25 | 8.1 |

"Oxidizing" in the "Sintering ambience" column indicates that the sintering can be carried out in the open air or other such oxidizing ambience.

EXAMPLE 3

With 4.5 g of the aqueous organic binder solution produced in Example 2, 95.5 g of spherical gold particles (having particle diameters in the range of 1–90 micrometers and an average particle diameter of 15 micrometers) were thoroughly kneaded. When the blend had progressed from the powdery state through the doughlike state to the clayish state, it was placed on three superposed food wrapping films and further kneaded to obtain a clayish composition.

A test piece, 100 mm in length, 10 mm in width and 1.0 mm in thickness, was produced from the clayish composition, dried at 100° C. for 30 minutes, then heated in an electric furnace from room temperature to the highest temperature indicated in Table 5, retained at this highest temperature for the period shown in Table 5, and then removed from the furnace. The shrinkage at the end of the sintering and the time required for the inner temperature of the furnace to reach 810° C. or higher were measured. The results are also shown in Table 5. Although a smaller shrinkage is better, the strength of the molded article after the sintering decreases at a shrinkage of less than 5%. Clays whose test pieces exhibited shrinkages of not less than 5% and not more than 10%, i.e. those enclosed by thick lines in Table 5, are suitable for practical use.

EXAMPLE 4

Test pieces were produced in the same manner as those in Example 3. A test piece was placed in an electric furnace heated in advance to a temperature (retained inner temperature of furnace) shown in FIG. 6 and sintered at that temperature for the length of time (retention period in furnace) shown in Table 6. The test piece after sintering was measured. The results are also shown in Table 6. Although a smaller shrinkage is better, the strength of the molded article after the sintering decreases at a shrinkage of less than 5%. Clays whose test pieces exhibited shrinkages of not less than 5% and not more than 10%, i.e. those enclosed by thick lines in Table 6, are suitable for practical use.

TABLE 5

| Elevation of temperature from room temperature (Room temperature to highest temperature) | | | | | | | | |
|---|---|---|---|---|---|---|---|---|
| Highest temperature (°C.) | Time of retention at the highest temperature (min) 0 | 3 | 5 | 10 | 20 | 30 | 45 | 60 |
| 790 | — | — | — | — | — | 3.3(0) | 4.0(0) | 4.6(0) |
| 810 | — | — | — | — | — | 4.6(30) | 5.1(45) | 5.3(60) |
| 830 | — | — | — | 2.9(12) | 3.4(22) | 5.0(32) | 5.7(47) | 5.8(62) |
| 850 | — | — | 3.1(9) | 4.2(14) | 4.8(24) | 5.3(34) | 5.7(49) | 7.2(64) |
| 900 | 4.5(9) | 4.7(12) | 5.0(14) | 5.2(19) | 5.5(29) | 6.4(39) | 7.6(54) | 9.1(69) |
| 950 | 5.3(14) | 5.6(17) | 6.0(19) | 6.3(24) | 7.9(34) | 8.7(44) | 9.9(59) | 10.5(74) |
| 990 | 8.5(20) | 9.0(23) | 9.6(25) | 10.0(30) | 10.8(40) | 11.1(50) | 11.8(65) | 12.3(80) |
| 1020 | 11.2(24) | 11.4(27) | 12.1(29) | 14.1(34) | — | — | — | — |

*The numerical values in parentheses represent the lengths of time (min) required for the inner temperature of the furnace to reach 810° C. or higher.

TABLE 6

| Retention in furnace kept at elevated temperature | | | | | | | |
|---|---|---|---|---|---|---|---|
| Temperature retained in furnace (°C.) | Retention period in furnace (min) 5 | 10 | 20 | 30 | 45 | 60 | 70 |
| 750 | — | — | — | — | — | 3.0 | 3.3 |
| 780 | — | — | — | — | 3.4 | 4.1 | 4.4 |
| 810 | — | 3.0 | 3.8 | 5.1 | 5.9 | 6.6 | 7.6 |
| 850 | — | 4.8 | 5.1 | 6.2 | 7.3 | 8.6 | 9.8 |
| 900 | 5.0 | 5.5 | 5.9 | 8.5 | 9.1 | 10.0 | 12.0 |
| 950 | 6.2 | 6.8 | 10.0 | 11.3 | 12.1 | — | — |
| 990 | 9.7 | 11.4 | — | — | — | — | — |
| 1020 | 10.8 | — | — | — | — | — | — |

Comparison of the results of Example 3 and Example 4 shows that the shrinkages obtained at equal sintering temperatures after equal lengths of retention were higher in the samples of Example 4 than those in Example 3. The reason for this is thought to be that when a sample is suddenly placed in a furnace heated to an elevated temperature in advance, heat generated by the organic binder heightens the inner temperature of the sintered article.

In Example 3, the organic binder burned as the furnace temperature rose from 200° to 400° C. so that the heat of this combustion did not contribute to the elevation of the temperature of the sintered article in the neighborhood of the highest temperature.

EXAMPLE 5

A rose-shaped part of an accessory was molded to a diameter of 30 mm of a clayish composition consisting of 85 wt % of a K18 alloy (75 wt % of Au, 15 wt % of Ag, 10 wt % of Cu) powder having particle diameters in the range of 1–100 micrometers and an average particle diameter of 15 micrometers, 2 wt % of methyl cellulose, 2 wt % of starch and 11 wt % of water. The molded article was left to dry for 30 minutes in a drier kept at 100° C.

This molded article was buried in 20 g of reducing agent-containing microwave-absorbing heat-generating particles were formed of a mixed powder consisting of 30 wt % of silicon carbide powder having an average particle diameter of 50 μm, 60 wt % of active carbon having an average particle diameter of 30 μm and 10 wt % of pulp fibers and were charged in an alumina crucible (heat-resistant container). The crucible was closed with a lid.

The crucible was set on a heat-resistant insulating material (20-mm-thick board marketed as Kaowool by Isolite Insulating Products Co., Ltd.) inside the heating chamber of a household grade microwave oven (2.54 GHz, output 500 W), and the heated therein for 3 minutes.

After the heating, the heat-resistant container and the heat-resistant insulating material were removed from the heating chamber of the microwave oven and left to cool at room temperature. When the surface temperature of the crucible had fallen below 35° C., the sintered article was removed from the heat-resistant container.

The sintered article thus obtained was found to be uniformly sintered, with the surface thereof showing no sign of oxidation.

EXAMPLE 6

A rose-shaped part of an accessory was molded to a diameter of 30 mm of a clayish composition obtained by mixing 90 wt % of an Ag powder having particle diameters in the range of 1–90 micrometers and an average particle diameter of 20 micrometers, 2 wt % of methyl cellulose and 1 wt % of starch and kneading the resultant mixture with 7 wt % of water. The part was left to dry for 30 minutes in a drier kept at 100° C. to obtain a molded article.

This molded article was buried in 20 g of microwave-absorbing heat-generating particles which were formed of a mixture consisting of 30 wt % of barium titanate powder having an average particle diameter of 45 micrometers and 70 wt % of active carbon having an average particle diameter of 30 micrometers and were charged in a cylindrical container made of silica.

The container holding the molded article was set on a heat-resistant insulating material (20-mm-thick board marketed as Kaowool by Isolite Insulating Products Co., Ltd.) in the heating chamber of a household grade microwave oven (2.45 GHz, output 500 W), and heated therein for 3 minutes.

After the heating, the heat-resistant container and the heat-resistant insulating material were removed from the healing chamber of the microwave oven and then left to cool at room temperature. When the surface temperature of the crucible had fallen below 35° C., the sintered article was removed from the heat-resistant container.

The sintered article thus obtained was found to be uniformly sintered. It showed no sign of thermal deformation.

EXAMPLE 7

A container (support) of the shape of a plant plot, 40 mm in diameter and 40 mm in height, was made of the same clayish composition as used in Example 6. A metallic paste composed of 90 wt % of an Au powder having particle diameters in the range of 1–20 micrometers and an average particle diameter of 3 micrometers and 10 wt % of a transfer grade acrylic binder was applied in a decorative pattern to the side surface of the container to obtain a molded article.

This molded article was buried in 20 g of microwave-absorbing heat-generating particles which were formed of a mixed powder consisting of 30 wt % of silicon carbide powder having an average particle diameter of 50 micrometers and 70 wt % of active carbon having an average particle diameter of 30 micrometers and were charged in a crucible of mullite (heat-resistant container).

The container holding the molded article was set on a heat-resistant insulating material (20-mm-thick board marketed as Kaowool by Isolite Insulating Products Co., Ltd.) in the heating chamber of a household grade microwave oven (2.45 GHz, output 500 W), and heated therein for 5 minutes.

After the heating, the heat-resistant container and the heat-resistant insulating material were removed from the heating chamber of the microwave oven and then left to cool at room temperature. When the surface temperature of the crucible had fallen below 35° C., the sintered article was removed from the heat-resistant container.

The sintered article thus obtained was found to be uniformly sintered without any thermal deformation. Thus a sintered plant plot having a gold pattern deposited on a background of silver was obtained.

EXAMPLE 8

A finger ring-like accessory (support), 20 mm in diameter, made of sterling silver and provided on the periphery thereof with a groove, 0.8 mm in depth and 1 mm in width was used to obtain a molded article by filling the groove thereof with the same clayish composition used in Example 5.

This molded article was buried in 20 g of a mixed powder (microwave-absorbing heat-generating particles) consisting of iron powder, active carbon, water, wood flour and salt (raw material for a disposable pocket hand warmer manufactured by Dainihon Jochugiku K. K.) and held in an alumina crucible (heat-resistant container). The crucible was closed with a lid. The container holding the molded article was set on a heat-resistant insulating material (20-mm-thick board marketed as Kaowool by Isolite Insulating Products Co., Ltd.) in the heating chamber of a household microwave oven (2.45 GHz, output 500 W) and heated therein for 4 minutes.

After the heating, the heat-resistant container and the heat-resistant insulating material were removed from the heating chamber of the microwave oven and then left to cool at room temperature. When the surface temperature of the crucible had fallen below 35° C., the sintered article was removed from the heat-resistant container.

The sintered article thus obtained was found to be uniformly sintered without any surface oxidation. A finger ring having a K18 alloy inlay formed in a background of sterling silver was obtained.

EXAMPLE 9

A finger ring-like accessory, 20 mm in diameter, was molded as a support from a clayish composition consisting of 95 wt % of sterling silver (92.5 wt % of Ag and 7.5 wt % of Cu) powder having particle diameters in the range of 1–60 micrometers and an average particle diameter of 10 micrometers, 0.5 wt % of methyl cellulose, 0.5 wt % of starch and 4 wt % of water. The same metallic paste as used in Example 7 was applied to the periphery of the support to obtain a molded article.

This molded article was buried in 20 g of a mixed powder (microwave-absorbing heat-generating particles) consisting of iron powder, active carbon, water, wood flour and salt (raw material for a disposable pocket hand warmer manufactured by Dainihon Jochugiku K. K.) and held in a mullite crucible (heat-resistant container). The crucible was closed with a lid.

The container holding the molded article was set on a heat-resistant insulating material (20-mm-thick board marketed as Kaowool by Isolite Insulating Products Co., Ltd.) in the heating chamber of a household microwave oven (2.45 GHz, output 500 W) and heated therein for 4 minutes.

After the heating, the heat-resistant container and the heat-resistant insulating material were removed from the heating chamber of the microwave oven and then left to cool at room temperature. When the surface temperature of the crucible had fallen below 35° C., the sintered article was removed from the heat-resistant container.

The sintered article thus obtained was found to be uniformly sintered without either surface oxidation or thermal deformation. A finger ring having a gold decorative pattern formed in a background of sterling silver was obtained.

EXAMPLE 10

The same clayish composition as used in Example 6 was deposited in a decorative pattern on the surface of a ceramic plate made of cordierite, 20 mm in diameter and 2 mm in thickness, to obtain a molded article.

This molded article was buried in 20 g of microwave-absorbing heat-generating particles consisting of a mixed powder of 30 wt % of boron carbide and 70 wt % of active carbon powder and held in an alumina crucible (heat-resistant container). The crucible was closed with a lid.

The container holding the molded article was set on a heat-resistant insulating material (20-mm-thick board marketed as Kaowool by Isolite Insulating Products Co., Ltd.) in the heating chamber of a household grade microwave oven (2.45 GHz, output 500 W) and heated therein for 3 minutes.

After the heating, the heat-resistant container and the heat-resistant insulating material were removed from the heating chamber of the microwave oven and then left to cool at room temperature. When the surface temperature of the crucible had fallen below 35° C., the sintered article was removed from the heat-resistant container.

The sintered article thus obtained was found to be uniformly sintered. A fine-art quality sintered article having a silver decoration formed on a ceramic plate was obtained.

EXAMPLES 11 AND 12

Two test pieces, each measuring 50 mm in length, 10 mm in width and 1.5 mm in thickness, were molded of a clayish composition consisting of 92 wt % of Cu powder having particle diameters in the range of 1–100 micrometers and an average particle diameter of 20 micrometers, 1 wt % of methyl cellulose, 1 wt % of starch, and 6 wt % of water and then dried to obtain a molded article.

Two heat-resistant alumina crucibles were each charged with 40 g of a mixed powder consisting of 25 wt % of silicon carbide powder having an average particle diameter of 50 micrometers, 25 wt % of active carbon powder having an average particle diameter of 3 micrometers and 50 wt % of alumina powder having an average particle diameter of 200 micrometers. One of the molded articles was buried in the mixed powder in each crucible and the crucible was closed with a lid. One of the crucibles was set on a heat-resistant insulating material (20-mm-thick board marketed as Kaowool by Isolite Insulating Products Co., Ltd.) in the heating chamber of a household grade microwave oven (2.45 GHz, output 500 W) and heated therein for 10 minutes.

After the heating, the heat-resistant container and the heat-resistant insulating material were removed from the heating chamber of the microwave oven and then left standing to cool at room temperature.

The other crucible was placed in an electric furnace whose interior was at room temperature, heated therein to 900° C. over a period of 90 minutes, kept at 900° C. for 30 minutes, removed from the electric furnace, and left to cool at room temperature. When the surface temperature of the heat-resistant container had fallen below 35° C., the sintered article was removed from the heat-resistant container.

The sintered articles from the two crucibles were both found to be thoroughly sintered without any surface oxidation. When they were tested for breaking force by means of a force gauge, they were both found to have an average breaking force of 23 kgf. The results indicate that they were sintered to an equal degree. The heating time was longer without use of a microwave oven.

EXAMPLES 13 AND 14

Two test pieces, each measuring 50 mm in length, 10 mm in width and 1.5 mm in thickness, were molded of the same clayish composition as used in Example 6 and then dried to obtain molded articles.

One of the molded articles was buried in 40 g of a mixed powder consisting of 25 wt % of silicon carbide powder having an average particle diameter of 50 micrometers, 25 wt % of active carbon powder having an average particle diameter of 30 micrometers and 50 wt % of alumina powder having an average particle diameter of 200 micrometers held in an alumina crucible (heat-resistant container) and the crucible was covered with a lid.

The crucible was set in place on a heat-resistant insulating material (20-mm-thick board marketed as Kaowool by Isolite Insulating Products Co., Ltd.) in the heating chamber of a household grade microwave oven (2.45 GHz, output 500 W) and heated therein for 8 minutes.

After the heating, the heat-resistant container and the heat-resistant insulating material were removed from the heating chamber of the microwave oven and then left standing to cool at room temperature.

The other crucible was placed in an electric furnace whose interior was at 800° C., kept at 800° C. for 30 minutes, removed from the electric furnace, and then left standing to cool at room temperature.

The two sintered articles thus obtained were both found to be uniformly sintered. When they were tested for breaking force by means of a force gauge, they were both found to have an average breaking force of 10 kgf. The results indicate that they were sintered to an equal degree. The heating time was longer without use of a microwave oven.

EXAMPLE 15

A sphere, 20 mm in diameter, was molded of a clayish mass obtained by preparing a mixed powder consisting of 29 wt % of silicon carbide powder having an average particle diameter of 50 micrometers, 68 wt % of active carbon powder having an average diameter of 30 micrometers and 3 wt % of methyl cellulose powder, adding a suitable amount of water to the mixed powder and kneading the produced blend. The sphere was dried to obtain a support.

Then, a syringe barrel made of polypropylene (PP) and provided with a nozzle, 0.5 mm in diameter, was filled with 10 g of the same clayish composition as used in Example 6. The clayish composition was extruded under pressure from the syringe onto the surface of the support (sphere) produced as described above and deposited in the pattern of a latticework (gauze) on the sphere. The sphere bearing the pattern of the clayish composition was left standing to dry in a drier kept at 100° C. for 30 minutes to obtain a molded article.

This molded article was buried in 20 g of microwave-absorbing particles formed of a mixed powder consisting of 30 wt % of silicon carbide powder having an average particle diameter of 50 micrometers and 70 wt % of active carbon powder having an average particle diameter of 30 micrometers and held in an alumina crucible (heat-resistant container).

The crucible was set on a heat-resistant insulating material (20-mm-thick board marketed as Kaowool by Isolite Insulating Products Co., Ltd.) in the heating chamber of a household grade microwave oven (2.45 GHz, output 500 W) and heated therein for 3 minutes.

After the heating, the heat-resistant container and the heat-resistant insulating material were removed from the heating chamber of the microwave oven and then left standing to cool at room temperature. When the surface temperature of the heat-resistant container had fallen below 35° C., the sintered article was extracted from the heat-resistant container. The support inside the sintered article flowed out freely like dry sand. The portion of the support which remained therein was extracted with a pair of pincers.

The sintered article thus obtained was found to be uniformly sintered without thermal deformation. As a result, a spherical hollow sintered article formed of a meshwork of silver was obtained. This spherical hollow sintered article was finished and fitted with an earwire to obtain a finished product.

Test Example 1

A test piece, 50 mm in length, 10 mm in width and 1.5 mm in thickness, was molded of the clayish composition used in Example 6 and then dried to obtain a molded article.

This molded article was buried in 50 g of silicon carbide powder having an average particle diameter of 50 micrometers and held in an alumina crucible (heat-resistant container) and the crucible was closed with a lid.

The crucible holding the molded article was set on a heat-resistant insulating material (20-mm-thick board marketed as Kaowool by Isolite Insulating Products Co., Ltd.) in the heating chamber of a household grade microwave oven (2.45 GHz, output 500 W) and then heated therein for 21 minutes.

After the heating, the heat-resistant container and the heat-resistant insulating material were removed from the heating chamber of the microwave oven and then left standing to cool at room temperature.

The sintered article thus obtained was found to be uniformly sintered.

Since the heating in the microwave oven was conducted for a considerable time, the magnetron and the microwave oven itself were heated to a fairly high temperature and the glass and the turntable in the heating chamber of the microwave oven were heated to the neighborhood of 100° C. From these results it can be seen that the treatment conditions should preferably be selected so that the heating time will be not more than 20 minutes.

Test Example 2

A test piece, 50 mm in length, 10 mm in width and 1.5 mm in thickness, was molded of the clayish composition used in Example 6 and then dried to obtain a molded article.

This molded article was buried in a mixed powder consisting of 10 g of iron powder having an average particle diameter of 50 micrometers and 40 g of mullite powder having an average particle diameter of 150 micrometers held in an alumina crucible (heat-resistant container) and the crucible was closed with a lid.

The crucible holding the molded article was set on a heat-resistant insulating material (20-mm-thick board marketed as Kaowool by Isolite Insulating Products Co., Ltd.) in the heating chamber of a household grade microwave oven (2.45 GHz, output 500 W) and then heated therein for 1 minute.

After the heating, the heat-resistant container and the heat-resistant insulating material were removed from the heating chamber of the microwave oven and then left standing to cool at room temperature.

The sintered article thus obtained was found to be uniformly sintered.

When another molded article of the same type was heated under the same conditions for less than 1 minute, the desired sintered article could not be obtained.

While there have been shown and described preferred embodiments of the invention, it is to be understood that the invention is not limited thereto but may be otherwise variously embodied and practiced within the scope of the following claims.

What is claimed is:

1. A clayish composition for producing a molded article of noble metal, consisting essentially of at least one noble metal powder selected from the group consisting of noble metal powders and noble metal alloy powders, starch and a water-soluble cellulose resin as organic binder and water, wherein the contents of said starch and said water-soluble cellulose resin each falls in the range of 0.02–3.0% by weight, based on the total amount of said organic binder and said noble metal powder.

2. The clayish composition according to claim 1, wherein the content of said organic binder is in the range of 0.1–4 wt %, based on the total amount of said organic binder and said noble metal powder.

3. The clayish composition according to claim 1, wherein said noble metal powder is mainly composed of particles having particle diameters in the range of 1–100 micrometers and an average particle diameter in the range of 5–30 micrometers.

4. A method for the production of a sintered article of noble metal, consisting essentially of a step of mixing and kneading at least one noble metal powder selected from the group consisting of noble metal powders and noble metal alloy powders with an aqueous solution of an organic binder consisting of starch and a water-soluble cellulose resin to produce a clayish composition wherein the contents of said starch and said water-soluble cellulose resin are each in the range of 0.02–3.0% by weight based on the total amount of said organic binder and said noble metal powder, a step of molding said clayish composition into a desired shape, a step of drying the resultant shaped article and a step of sintering the dried shaped article.

5. The method according to claim 4, wherein said sintering is conducted at a temperature in a range of 70°– 250° C. lower than the melting point of the noble metal.

6. The method according to claim 4, wherein said sintering is conducted by burying a molded article in a dried state in a mass of microwave-absorbing heat-generating particles having particle diameters in the range of 5–3500 micrometers, manifesting flowability as a mass and generating heat by absorbing microwaves and irradiating said mass of microwave-absorbing heat-generating particles with microwaves.

7. The method according to claim 6, wherein said irradiation of said mass of microwave-absorbing heat-generating particles with microwaves is accomplished by placing said dry molded article as buried in said mass of microwave-absorbing heat-generating particles in a microwave oven and heating said molded article as buried in said microwave oven for a period in the range of 2–20 minutes.

8. The clayish composition according to claim 1, wherein said at least one noble metal powder is selected from the group consisting of Au, Ag, Pt, Pd, Rh, Ru, Ir, and Os and alloys having at least one of these metals as a main component.

9. The clayish composition according to claim 1, wherein said starch is α-starch.

10. The clayish composition according to claim 1, wherein said starch is β-starch.

11. The method according to claim 4, wherein in said clayish composition said at least one noble metal powder is selected from the group consisting of Au, Ag, Pt, Pd, Rh, Ru, Ir, and Os and alloys having at least one of these metals as a main component.

12. The method according to claim 4, wherein in said clayish composition said starch is α-starch.

13. The method according to claim 4, wherein in said clayish composition said starch is β-starch.

14. The method according to claim 6, wherein said microwave-absorbing heat-generating particles are formed of at least one member selected from the group consisting of carbon, active carbon, ferrite, silicon carbide, boron carbide, boron nitride, aluminum nitride, iron oxide, cast iron, iron, copper, zinc oxide, barium titanate, barium zirconate and lead titanate.

* * * * *